US005803757A

United States Patent [19]

Wang

[11] Patent Number: 5,803,757

[45] Date of Patent: Sep. 8, 1998

[54] AUTO-TERMINATION SINGLE JACK BNC CONNECTOR

[76] Inventor: Tsan-Chi Wang, 4th Floor, No. 8, Alley 8, Lane Ssu-Wei, Chung Cheng Rd., Hsin-Tien City, TaipeiHsien, Taiwan

[21] Appl. No.: 789,791

[22] Filed: Jan. 29, 1997

[51] Int. Cl.[6] ..... H01R 29/00

[52] U.S. Cl. ..... 439/188; 439/944

[58] Field of Search ..... 439/188, 944

[56] References Cited

U.S. PATENT DOCUMENTS 5,108,300 4/1992 Weber ..... 439/944

5,340,325 8/1994 Pai ..... 439/188

*Primary Examiner*—Neil Abrams
*Assistant Examiner*—T. C. Patel
*Attorney, Agent, or Firm*—Fish & Richardson P.C.

[57] ABSTRACT

An auto-termination single jack BNC connector including a metal casing, a front insulating socket, a rear insulating socket, a signal terminal, and a circuit termination terminal, wherein the circuit termination terminal is disposed in contact with the signal terminal to terminate the circuit when the auto-termination single jack BNC connector is not connected with a BNC plug; the circuit termination terminal is disconnected from the signal terminal when a BNC plug is connected to the auto-termination single jack BNC connector for signal transmission through the signal terminal.

7 Claims, 6 Drawing Sheets

AUTO-TERMINATION SINGLE JACK BNC CONNECTOR

BACKGROUND OF THE INVENTION

The present invention relates to single jack BNC connectors for connection between a network and a circuit board of a computer or electronic instrument, and relates more particularly to an auto-termination single jack BNC connector which automatically terminates the circuit when a mating connector is disconnected from the BNC connector.

RG58 coaxial cables and RJ46 telephone lines are commonly used for connecting a computer network and individual personal computers. Therefore, the network extension card of a personal computer is generally equipped with a single jack BNC connector and a telephone module jack for the connection of a RG58 coaxial cable through a BNC plug and a RJ46 telephone line through a telephone module plug. The network extension card has a control IC, which stops computer data from passing to the single jack BNC connector and the telephone module jack when the computer is not connected with a network connector. When the single jack BNC connector or the telephone module jack of the network extension card of the computer is connected to a computer network through a BNC plug or a telephone module plug, the IC no longer provides a signal to stop the transmission of signals from the computer to the computer network. Therefore, when the single jack BNC connector or the telephone module jack is connected to the computer network, computer data will be transmitted to the single jack BNC connector as well as the telephone module jack. At the same time, external noises may pass through the single jack BNC connector to the internal circuit of the computer.

FIG. 1 shows a single jack BNC connector according to the prior art, which is also an invention of the present inventor. This structure of single jack BNC connector comprises a metal casing 91, a ground terminal 92, a signal terminal 93, and an insulator 94. Because this structure of single jack BNC connector cannot automatically terminate the circuit, external noises tend to pass to the inside of the computer when the user uses a RJ45 telephone line to connect the telephone module jack to connect of the computer to the computer network. There is known dual-jack BNC connectors adapted for connecting individual personal computers to a coaxial cable of a computer network. These dual-jack BNC connectors do not have an automatic circuit termination function. When a personal computer is equipped with a dual-jack BNC connector, it does not use a telephone module jack for the connection of a telephone line of a computer network. Therefore, when the dual-jack BNC connector is not connected to the computer network, the control IC of the network extension card will automatically stop computer signal from passing to the dual-jack BNC connector. However, when one jack of the dual-jack BNC connector is connected with a BNC plug, computer signals will be sent to both jacks of the dual-jack BNC connector, causing a signal loss.

SUMMARY OF THE INVENTION

It is one object of the present invention to provide an auto-termination single jack BNC connector which, when a mating connector is disconnected from the BNC connector, automatically terminates the circuit to prevent interference of noises or loss of signal. It is another object of the present invention to provide an auto-termination single jack BNC connector which can be coupled with capacitor means to eliminate the interference of noises. It is still another object of the present invention to provide an auto-termination single jack BNC connector which is compact and simple, and convenient for mass production.

According to one embodiment of the present invention, the auto-termination single jack BNC connector is comprised of a metal casing, a front insulating socket, a rear insulating socket, a signal terminal, and a circuit termination terminal. The metal casing holds the front insulating socket and the rear insulating socket on the inside. The signal terminal is mounted in a first locating groove of the front insulating socket and a first locating groove of the rear insulating socket, and partially protruding over the front end of the metal casing. The circuit termination terminal is mounted in a second locating groove of the front insulating socket and a second locating groove of the rear insulating socket, and partially protruding over the front end of the metal casing. The circuit termination terminal is disposed in contact with the signal terminal to terminate the circuit when the auto-termination single jack BNC connector is not connected with a BNC plug. On the contrary, the circuit termination terminal is disconnected from the signal terminal when a BNC plug is connected to the auto-termination single jack BNC connector for signal transmission through the signal terminal.

DETAILED DESCRIPTION OF THE PREFERRED EMBODIMENT

Figure 1:
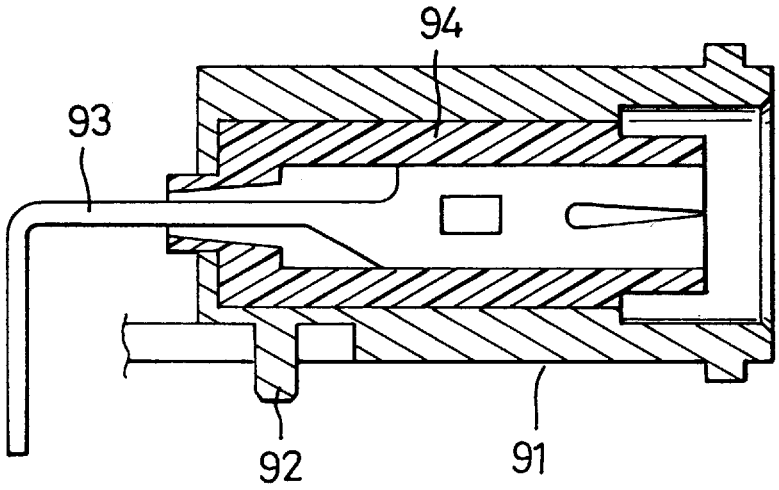
FIG. 1 PRIOR ART
FIG. 1 is a sectional view of a single jack BNC connector according to the prior art.
Figure 2:
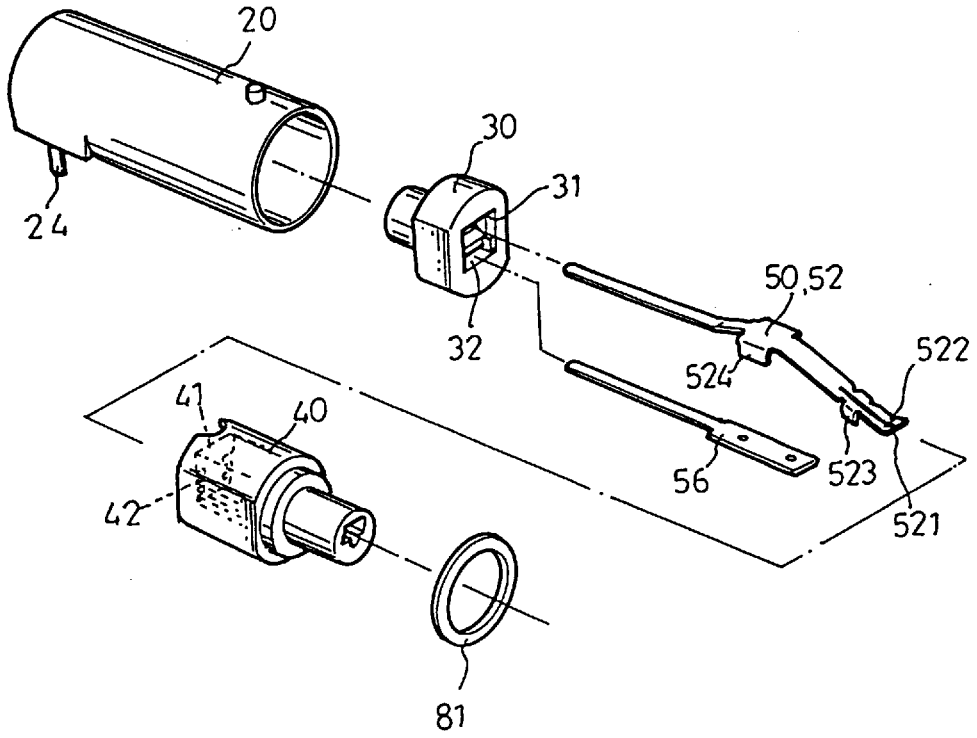
FIG. 2 is an exploded view of an auto-termination single jack BNC connector according to a first embodiment of the present invention.
Figure 3:
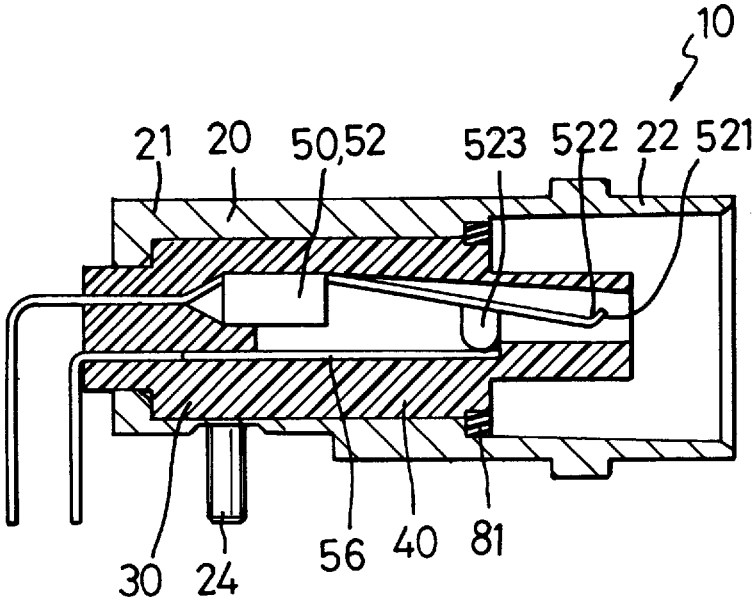
FIG. 3 is a sectional assembly view of the auto-termination single jack BNC connector shown in FIG. 2.

Referring to FIGS. 2 and 3, a single jack BNC connector 10 in accordance with the present invention is generally comprised of a cylindrical metal casing 20, a front insulating socket 30, a rear insulating socket 40, a signal terminal 50, and a circuit termination terminal 56.

The metal casing 20 receives the front insulating socket 30 and the rear insulating socket 40, having a plurality of metal mounting pins 24 on the outside adapted for fastening to respective mounting holes in a PC board and connecting to ground terminal. The front end hereinafter described refers to the direction coupled to the PC board, and the rear end refers to the direction coupled to the BNC plug, referenced by 85 (see FIG. 4). The metal casing 20 has a front end 21, and a rear end 22. The front insulating socket 30 comprises a first locating groove 31 and a second locating groove 32 respectively disposed on the inside at different elevations. The rear insulating socket 40 comprises a first locating groove 41 and a second locating groove 42. The signal terminal 50 is mounted in the first locating groove 31 of the front insulating socket 30 and the first locating groove 41 of the rear insulating socket 40, and partially protruding over the front end 21 of the metal casing 20. The circuit termination terminal 56 is mounted in the second locating groove 32 of the front insulating socket 30 and the second locating groove 42 of the rear insulating socket 40, and partially protruding over the front end 21 of the metal casing 20.

During the assembly process of the single jack BNC connector 10, the signal terminal 50 is inserted into the first locating groove 42 of the rear insulating socket 40 and the circuit termination terminal 56 is inserted into the second locating groove 42 of the rear insulating socket 40, then the front end of the signal terminal 50 and the front end of the circuit termination terminal 56 are respectively inserted into the first locating groove 31 and second locating groove 32 of the front insulating socket 30, and then the abutted front insulating socket 30 and rear insulating socket 40 are inserted into the metal casing 20, and then a packing ring 81 is press-fit into the inside of the metal casing 20 to secure the front insulating socket 30 and the rear insulating socket 40 in place.

Figure 4:
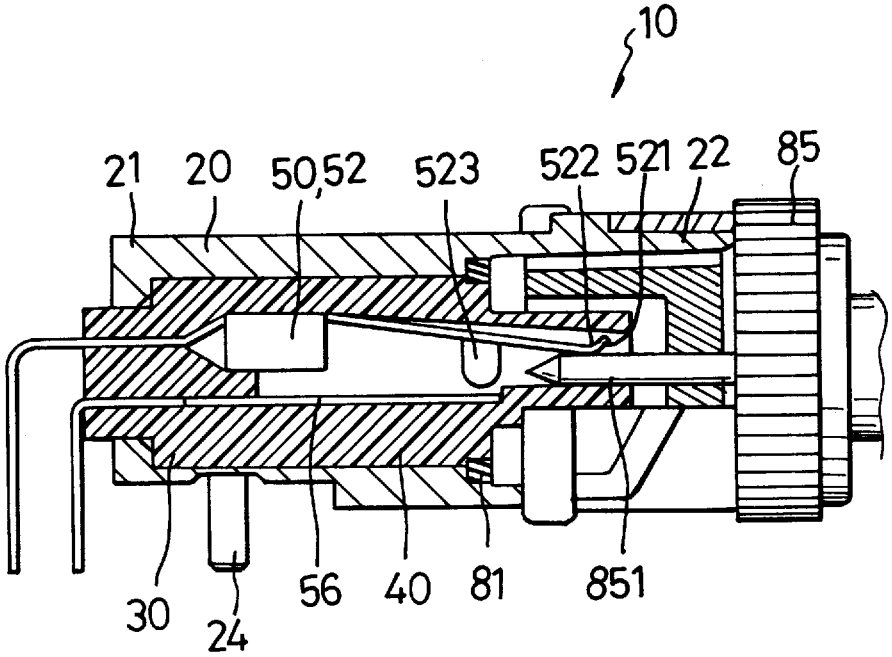
FIG. 4 is similar to FIG. 3 but showing a BNC plug connected, the circuit termination terminal disconnected from the signal terminal.

Referring to FIG. 4, and FIG. 2 again, the signal terminal 50 comprises a springy wing plate 52 at one end. The wing plate 52 has a turning point 522 forming a guide face 521 adapted for guiding the signal terminal 851 of the BNC plug 85 into position, two contact legs 523, and two reinforcing strips 524. The contact legs 523 are adapted for contacting the circuit termination terminal 56 to terminate the circuit. Resistor or capacitor means are installed in the circuit, which returns the circuit termination terminal 56 to the PC board, to remove outside noises. The reinforcing strips 524 reinforce the spring power of the wing plate 52, and are adapted for securing the wing plate 52 in the front insulating socket 30 and the rear insulating socket 40. When the BNC plug 85 is inserted into the single jack BNC connector 10, the rear end of the wing plate 52 is forced into contact with the signal terminal 851 of the BNC plug 85, and at the same time the contact legs 523 are lifted from the circuit termination terminal 56. Therefore, the circuit termination terminal 56 is disconnected from the signal terminal 50, and does no work.

Figure 5:
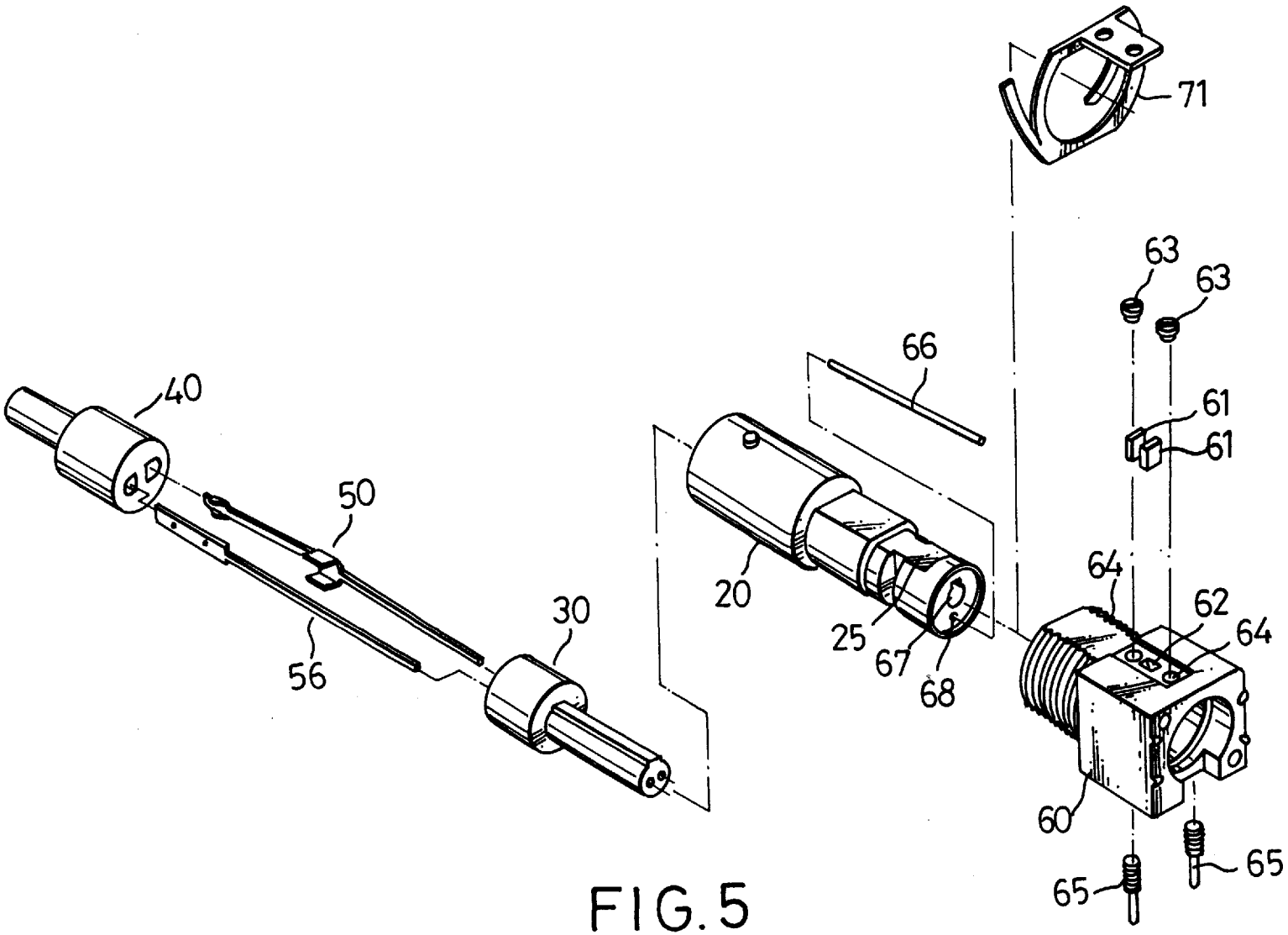
FIG. 5 is an exploded view of an auto-termination single jack BNC connector according to a second embodiment of the present invention.
Figure 6:
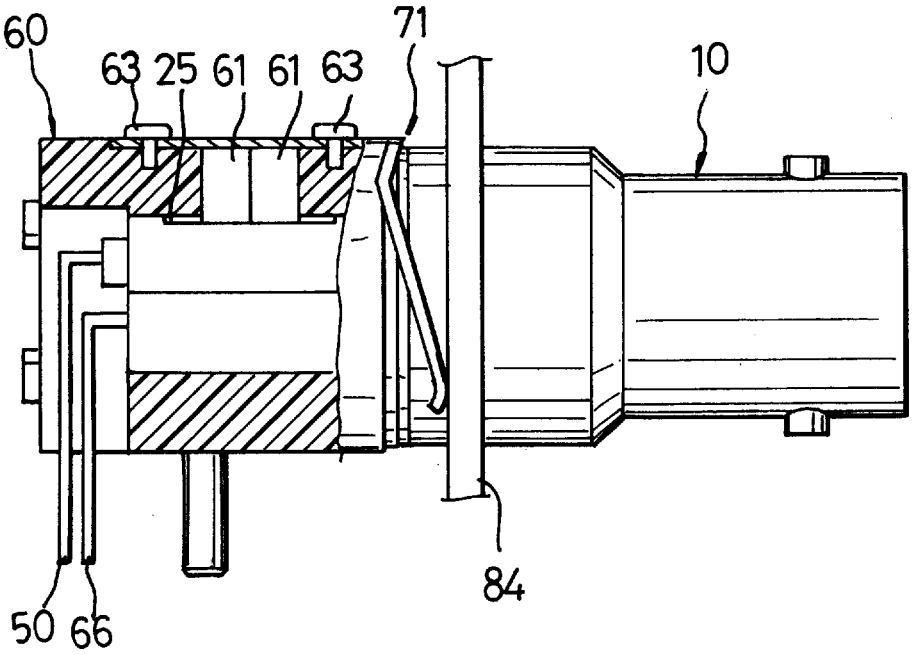
FIG. 6 is a sectional assembly view of the auto-termination single jack BNC connector shown in FIG. 5.

FIGS. 5 and 6 show an alternate form of the present invention. This alternate form comprises a coupling block 60, and two capacitor elements 61. When the signal terminal 50 and the circuit termination terminal 56 are respectively mounted in the front insulating socket 30 and the rear insulating socket 40, the front insulating socket 30 and rear insulating socket 40 are inserted through a metal ring plate 71 into the metal casing 20. The front end 21 of the metal casing 20 has a first round hole 67 and a second round hole 68 through which the signal terminal 50 and the circuit termination terminal 56 extend out of the front end 21 of the metal casing 20 for connection to the printed circuit board. Further, a ground terminal 66 is fitted into the second round hole 68. The capacitor elements 61 are mounted in a hole 62 in the coupling block 60. Rivets 63 are fastened to mounting holes 64 in the coupling block 60 to secure the metal ring plate 71 to the coupling block 60, permitting the capacitor elements 61 to be forced by the metal ring plate 71 into contact with the metal casing 20 at a plane 25 thereof. The metal ring plate 71 is further fastened to a metal frame 84. Because the capacitor elements 61 are disposed in contact with the metal ring plate 71 and the metal ring plate 71 is connected to the metal frame 84, outside noises are transmitted through the metal frame 84 and the metal ring plate 71 to the capacitor elements 61, and then filtered by the capacitor elements 61.

Figure 7:
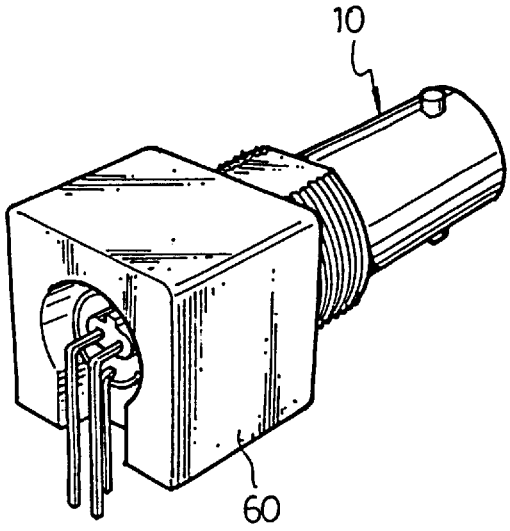
FIG. 7 is an elevational view of an auto-termination single jack BNC connector according to a third embodiment of the present invention; and, FIG. 8 is an applied view of the present invention, showing the auto-termination single jack BNC connector installed in a printed circuit board.

FIG. 7 shows another alternate form of the present invention. This alternate form is similar to the embodiment shown in FIG. 5. However, this alternate form eliminates the installation of the aforesaid capacitor elements 61 and the metal ring plate 71, and the coupling block 60 does not have the aforesaid hole 62, mounting holes 64, and rivets 63.

Figure 8:
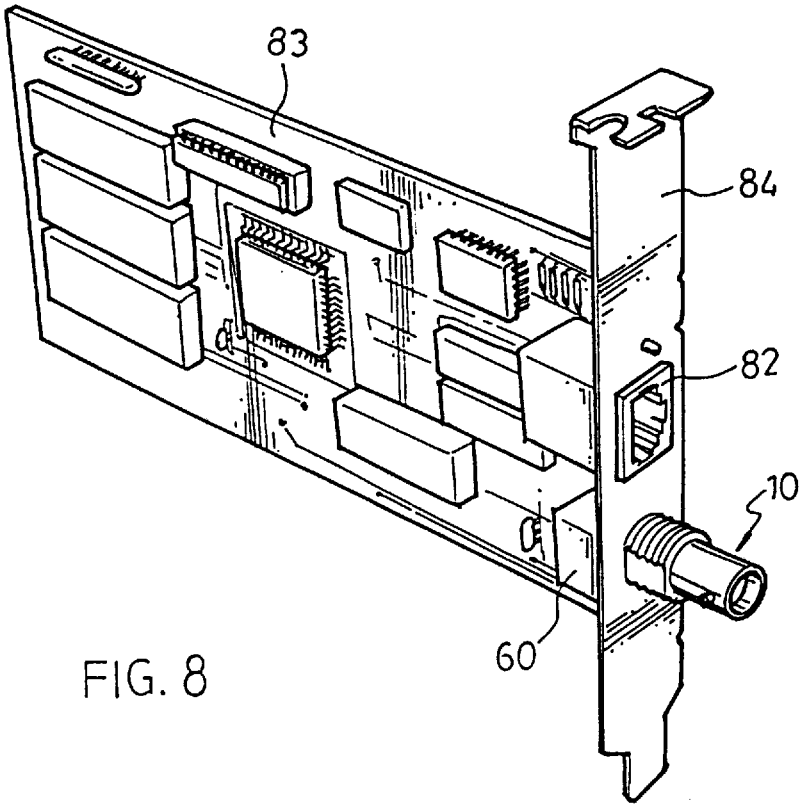

FIG. 8 shows the single jack BNC connector of FIG. 7 mounted in a hole in a metal frame 84 and connected to a printed circuit board 83, which has a telephone jack 82 installed in the metal frame 84.

It is to be understood that the drawings are designed for purposes of illustration only, and are not intended as a definition of the limits and scope of the invention disclosed.

What the invention claimed is:

1. An auto-termination single jack BNC connector comprising a metal casing, a front insulating socket, a rear insulating socket, a signal terminal, and a circuit termination terminal, wherein:

said metal casing having an inner volume for supporting said front insulating socket and said rear insulating socket, said metal casing having a front end, and a rear end, the rear end of said metal casing being adapted for receiving a BNC plug;

said front insulating socket is mounted within said metal casing near a front end of the front insulating socket, said front insulating socket having a first passage, and a first locating groove and a second locating groove axially disposed on an inner wall of the front insulating socket defining the first passage;

said rear insulating socket is mounted within said metal casing near a rear end of the rear insulating socket and abutted against said front insulating socket, said rear insulating socket having a second passage, and a first locating groove and a second locating, groove axially disposed on an inner wall of the second insulating socket defining the second passage;

said signal terminal is made from metal and mounted in the first locating groove of said front insulating socket and the first locating groove of said rear insulating socket, said signal terminal partially extending out of the front end of said metal casing for connection to a printed circuit board;

said circuit termination terminal is made from metal and mounted in the second locating groove of said front insulating socket and the second locating groove of said rear insulating socket, and partially extending out of the front end of said metal casing, said circuit termination being electrically connected directly to said printed circuit board, said circuit termination terminal being disposed in contact with said signal terminal to terminate the circuit when the auto-termination single jack BNC connector is not connected with a BNC plug, said circuit termination terminal being disconnected from said signal terminal when a BNC plug is installed and connected to said signal terminal.

2. The auto-termination single jack BNC connector of claim 1 wherein said signal terminal comprises a resilient wing plate at one end near, said wing plate having a turning point forming a guide face adapted for guiding a signal terminal of a BNC plug into contact with the signal terminal of the auto-termination single jack BNC connector, and at least one contact leg adapted for contacting said circuit termination terminal to terminate the circuit.

3. The auto-termination single jack BNC connector of claim 1 wherein said metal casing comprises a plurality of mounting pins adapted for mounting on said circuit board and connecting to a ground terminal.

4. The auto-termination single jack BNC connector of claim 1 further comprising a coupling block made from an electrically insulating material and adapted for securing said metal casing to a metal frame, said coupling block receiving at least the front end of said metal casing.

5. The auto-termination single jack BNC connector of claim 4 further comprising a metal ring plate mounted around said coupling block and connected to said metal frame, and a capacitive element mounted in said coupling block and connected between said metal casing and said metal ring plate.

6. The auto-termination single jack BNC connector of claim 4 further comprising a ground terminal fastened to said metal casing.

7. The auto-termination single jack BNC connector of claim 5 further comprising a ground terminal fastened to said metal casing.

* * * * *